US006938321B2

(12) United States Patent
Hentges et al.

(10) Patent No.: US 6,938,321 B2
(45) Date of Patent: Sep. 6, 2005

(54) PALLET SCUFFING APPARATUS

(75) Inventors: Jeff Hentges, Olathe, KS (US); Philip King, Bonner Springs, KS (US); William J. Rehrig, Leawood, KS (US)

(73) Assignee: Rehrig Pacific Company, Los Angeles, CA (US)

( * ) Notice: Subject to any disclaimer, the term of this patent is extended or adjusted under 35 U.S.C. 154(b) by 3 days.

(21) Appl. No.: 10/465,927

(22) PCT Filed: Jan. 2, 2002

(86) PCT No.: PCT/US02/00032

§ 371 (c)(1),
(2), (4) Date: Jan. 15, 2004

(87) PCT Pub. No.: WO02/053465

PCT Pub. Date: Jul. 11, 2002

(65) Prior Publication Data

US 2004/0115016 A1 Jun. 17, 2004

Related U.S. Application Data

(60) Provisional application No. 60/259,454, filed on Jan. 2, 2001.

(51) Int. Cl.[7] ..... B23C 1/04; B23C 3/13; B65D 19/38

(52) U.S. Cl. ..... 29/557; 409/145; 409/157; 409/131; 83/867; 407/31; 108/57.28; 144/237; 29/33 K

(58) Field of Search ..... 409/131–132, 409/145, 157, 159, 192, 203, 213, 217; 83/866–868; 407/31, 58–59; 72/703; 108/51.11, 57.25, 57.28; 144/374, 237; 29/557, 700, 33 K, 564.1

(56) References Cited

U.S. PATENT DOCUMENTS

| | | | | |
|---|---|---|---|---|
| 3,613,605 A | * | 10/1971 | Holdredge, Jr. | 108/57.28 |
| 3,850,115 A | * | 11/1974 | Mackes | 414/787 |
| 3,938,818 A | * | 2/1976 | Studeny et al. | 280/19 |
| 3,986,543 A | * | 10/1976 | Slayton et al. | 407/31 |
| 4,051,787 A | | 10/1977 | Nishitani et al. | |
| 4,137,956 A | | 2/1979 | Toberg | |
| 4,836,254 A | * | 6/1989 | Ruddick | 144/362 |
| 6,006,677 A | | 12/1999 | Apps et al. | |

* cited by examiner

*Primary Examiner*—Erica Cadugan
(74) *Attorney, Agent, or Firm*—Brooks Kushman P.C.

(57) ABSTRACT

A scuffing device (30) arranged to impart texture to a plastic pallet surface (12) having a plurality of cutting members (34) axially aligned and mounted adjacent each other, the cutting members (34) having radial toothed edges for cutting into and imparting texture to the plastic pallet surface upon rotating engagement therewith. The device further having a shaft upon which the cutting members are mounted for providing rotational movement to the cutting members.

17 Claims, 4 Drawing Sheets

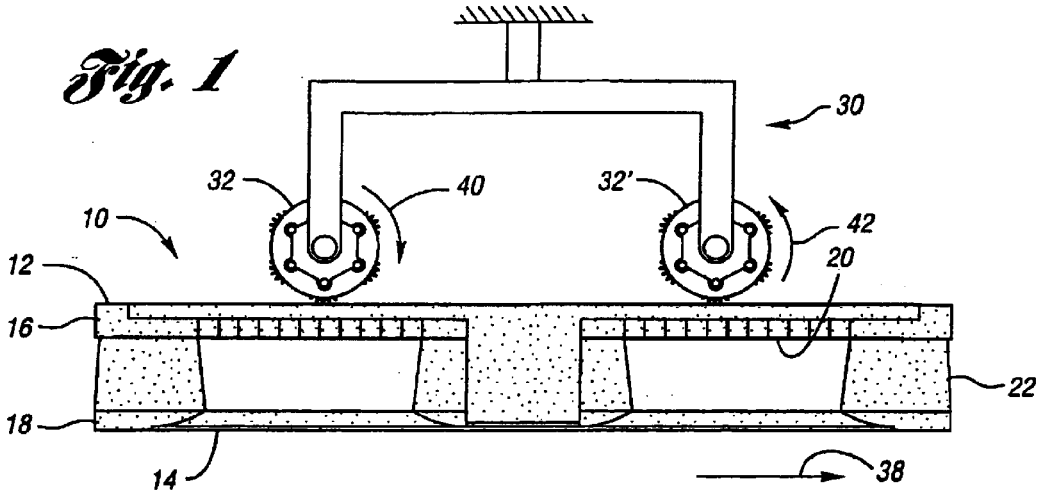
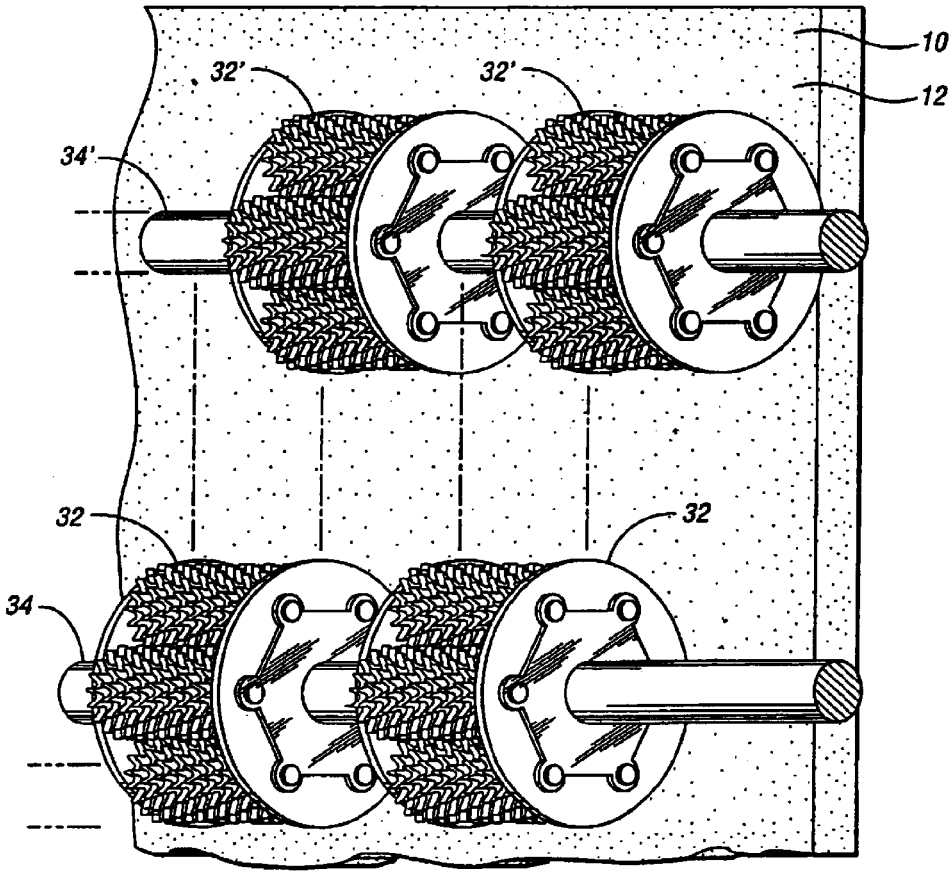
Fig. 2

PALLET SCUFFING APPARATUS

CROSS-REFERENCE TO RELATED APPLICATION

This application claims the benefit of U.S. provisional application Ser. No. 60/259,454, filed Jan. 2, 2001.

BACKGROUND OF THE INVENTION

1. Field of the Invention

This invention relates to an apparatus for scuffing and for providing a slip-resistant surface to a plastic pallet which supports freight, goods, or other materials, to a process for preparing a slip resistant surface, and to plastic pallets thus prepared.

2. Background Art

Plastic pallets may have surfaces which tend to be slippery as a result of the material and molding process. Accordingly, measures may be taken to prevent loads from possibly sliding off the pallet, as well as to keep the stacked pallets from sliding off one another, and further, to keep the pallet from sliding off the forks of the fork lift or a lift truck. Common anti-slip measures for pallets involve the use of anti-slip coatings or rubber inserts, such as pads or grommets, placed in strategic locations. Examples are shown in FIGS. 20–25 of U.S. Pat. No. 4,051,787. One drawback of these aforementioned anti-slip measures is that they require the installation of additional parts or materials to a finished pallet and thus required increased material and labor cost. Further, anti-slip coatings can wear away, and inserts can work loose and fall off during use, rendering them ineffective.

Another pallet scuffing technique is disclosed in U.S. Pat. No. 6,006,677, which discloses creating a multi-directional scuffing pattern by brushing the pallet surface with at least one cup-shaped wire brush. While this technique may be effective, a wire brush may not provide the desired level of slip resistance and scuffing desired in many industrial and heavy use applications.

Consequently, there is a need for a pallet scuffing apparatus and technique which provides anti-slip and anti-skid properties to plastic pallets. This apparatus and method should produce textures which do not easily wear away, work loose, or fall off during use.

SUMMARY OF THE INVENTION

An object according to the present invention is to provide a plastic pallet that has sufficient anti-slip and anti-skid features in the areas that provide support to the load, contact the fork of a forklift, as well as the areas which may contact the ground or other pallets in a stacked orientation.

Another object according to the present invention is to provide a plastic pallet wherein the anti-slip feature will not work loose or wear away, but instead is integral with the pallet.

In keeping with the above goals and objects according to the present invention, provided is an improved plastic pallet having a load bearing surface with an improved slip resistant, scuffed texture formed integrally therein. The pallet may also include a bottom surface and a fork contacting region which also include a slip resistant, scuffed texture. In one embodiment, the plastic pallet includes an upper deck and a lower deck, the upper deck having a top surface and the lower deck having a bottom surface. Thus, the top surface defines the load contacting surface, and the bottom surface defines the lower contact surface. The upper deck may also include a bottom surface which defines the fork contacting region and which also includes the slip resistant, scuffed texture. The scuffed texture may be formed on the pallet in a unilateral direction or in a multi-directional pattern. A preferred method of defining the scuffed texture on the pallet is by applying a surface preparation tool having multiple cutters.

The objects, features, and advantages of the present invention are readily apparent from the following detailed description of the best modes for carrying out the invention when taken in connection with the accompanying drawings wherein like reference numerals correspond to like components.

BRIEF DESCRIPTION OF THE DRAWINGS

FIG. 1 is a side view of the apparatus according to the present invention as applied to a pallet surface;

FIG. 2 is a perspective view of the cutter bundles and spindles of the apparatus according to the present invention;

DETAILED DESCRIPTION OF THE PREFERRED EMBODIMENT(S)

Figure 3:
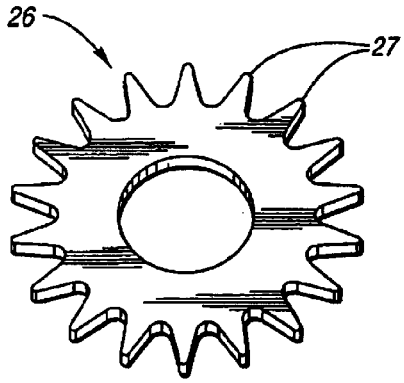
FIG. 3 is a perspective view of a cutting disk from the cutter bundles according to the present invention.

A pallet 10 is provided according to the present invention. Pallet 10 includes an upper surface 12 and a lower surface 14. In one embodiment, the pallet includes an upper deck 16 which includes upper surface 12, and a lower deck 18 which includes bottom surface 14. Upper surface 12 is typically the load bearing and load contacting surface, while bottom surface 14 is the pallet support surface, and generally contacts the ground, floor or other pallets when positioned in a stacked orientation.

Pallet 10 is preferably injection molded and formed of from a thermoplastic material, such as high density polyethylene or polypropylene. The material used to form pallet 10 may have a rather slippery surface just after molding and when the pallet is new. This slippery surface is undesirable in certain areas, such as the top surface 12 of upper deck 16; the bottom surface 14 of lower deck 18; and also the lower surface 20 of upper deck 16, and the areas between the columns or supports 22, these being the areas which are adapted to rest on the forks of a forklift when in use.

In accordance with the teachings of the present invention, in order to achieve the desired anti-slip and scuffing properties, a pallet scuffing apparatus 30 is applied to the desired surfaces (12, 14, 20) of pallet 10. Apparatus 30 includes at least one and preferably a plurality of cutter bundles 32, each of which is fixedly mounted to a spindle 34 to provide rotational movement to the cutter bundles 32 (See FIGS. 6, 7 and 8). While upper surface 12 and lower surface 14 may be treated to this scuffing technique at any time, it is contemplated that the fork contacting region 20 is scuffed before the upper and lower decks 16,18 are joined together.

The cutter bundles 32 are of the type manufactured by Aurand Manufacturing and Equipment Company, Inc. located in Cincinnati, Ohio, and sold as part of cutting tools bearing Model Nos. M5-1/M5-1E, and M5-2/M5-2E. The cutter bundles 32 themselves may be of the type bearing Model No. 90M. Such cutter bundles 32 in association with the cutting tools are used to remove paint, rust, and scale from wrought iron, large pipes, tanks and valves, beams and girders, and for scoring concrete. Accordingly, while such cutter bundles 32 have been used to remove coatings from typically metallic surfaces, the teachings according to the present invention apply the cutter bundles 32 to various surfaces 12, 14, 20 of a plastic pallet 10 in order to abrade the surfaces and provide an improved anti-skid and anti-slip scuffing surface. The cutter bundles 32 are typically formed of high quality steel, and under some circumstances, it may be necessary to apply a cooling liquid, such as water, to the cutter bundles during operation. Particularly, the cutter bundles 32 include a plurality of bundled serrated disks 26 (see a type of individual disk 26 in FIG. 3) fixedly mounted adjacent to each other.

Figure 4:
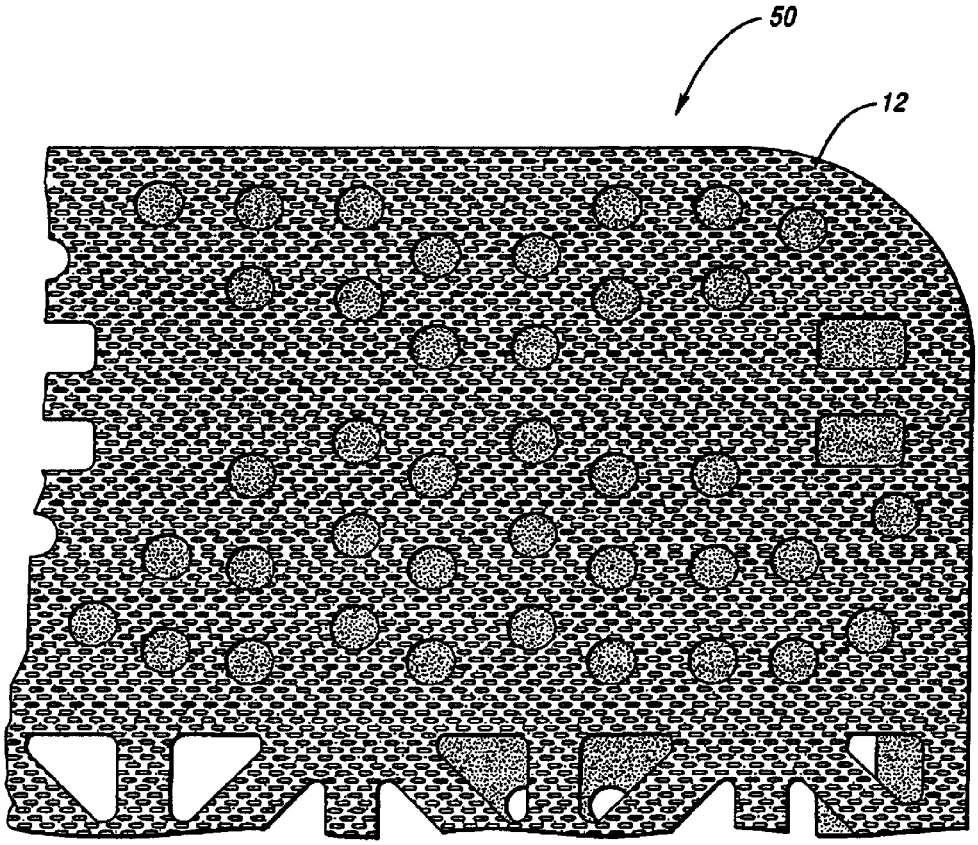
FIGS. 4, 5, and 6 are views of a plastic pallet sections to which the apparatus disclosed herein has been applied to a surface thereof.
Figure 5:
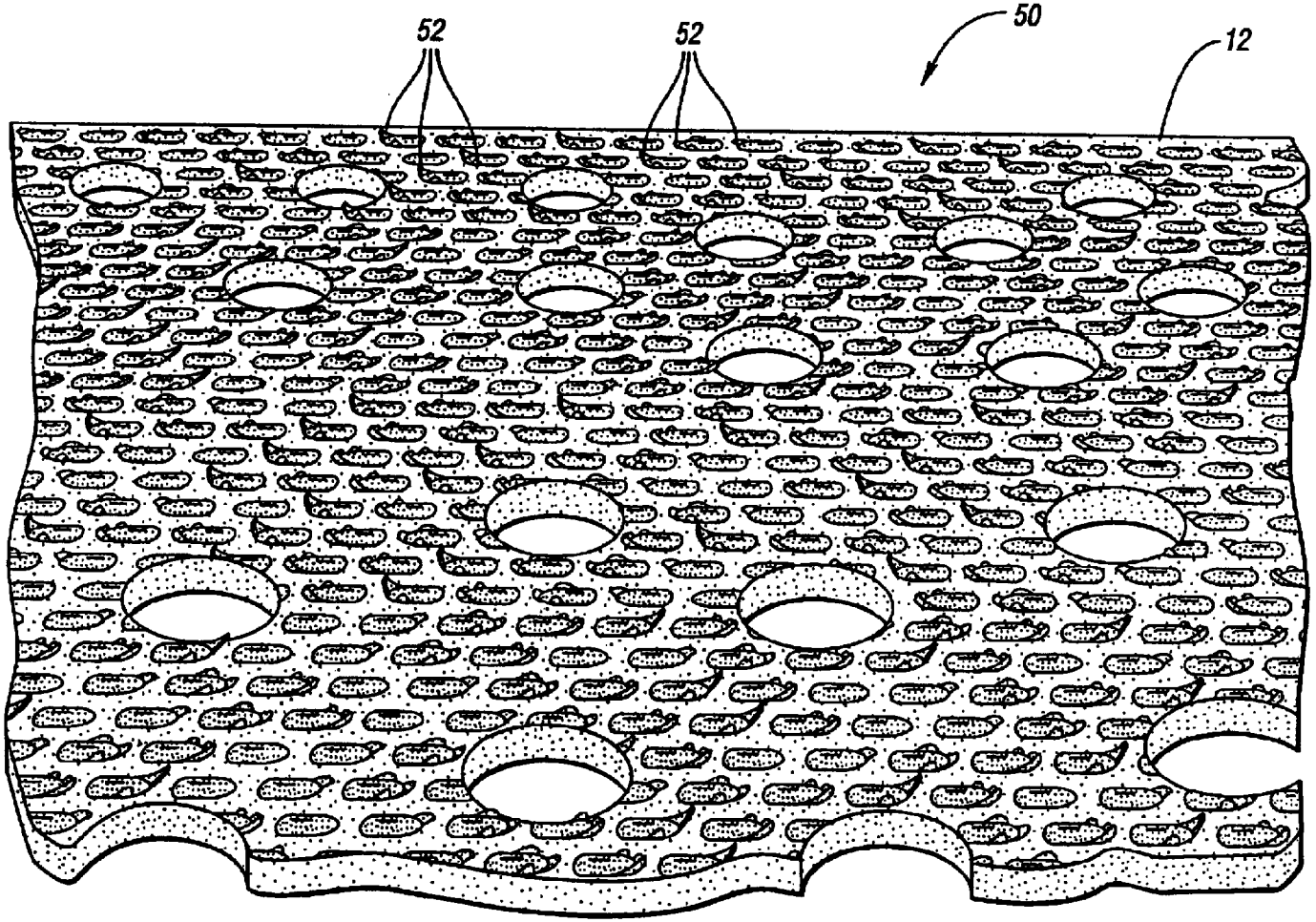

FIGS. 4 and 5 illustrate a corner portion 50 of a plastic pallet 10 to which the apparatus 30 having cutter bundles 32 according to the present invention have been applied. As illustrated in FIGS. 1 and 4, the cutter bundles 32 perform a shearing action against the pallet surface, thereby causing the teeth 27 to scrape or gouge the pallet surface, shaving the appropriate surface of the pallet 10 in order to lift up various portions of plastic material. This shaving creates a plurality of relatively small plastic peels 52, as shown in FIG. 5 much of which remain attached to the pallet 10, resembling a napped surface. This provides a desired scuffed, anti-slip surface not provided by those techniques and devices of the prior art. Note that some of the plastic peels may become separated from the pallet during the scuffing process, thereby defining an improved roughened plastic surface.

Figure 6:
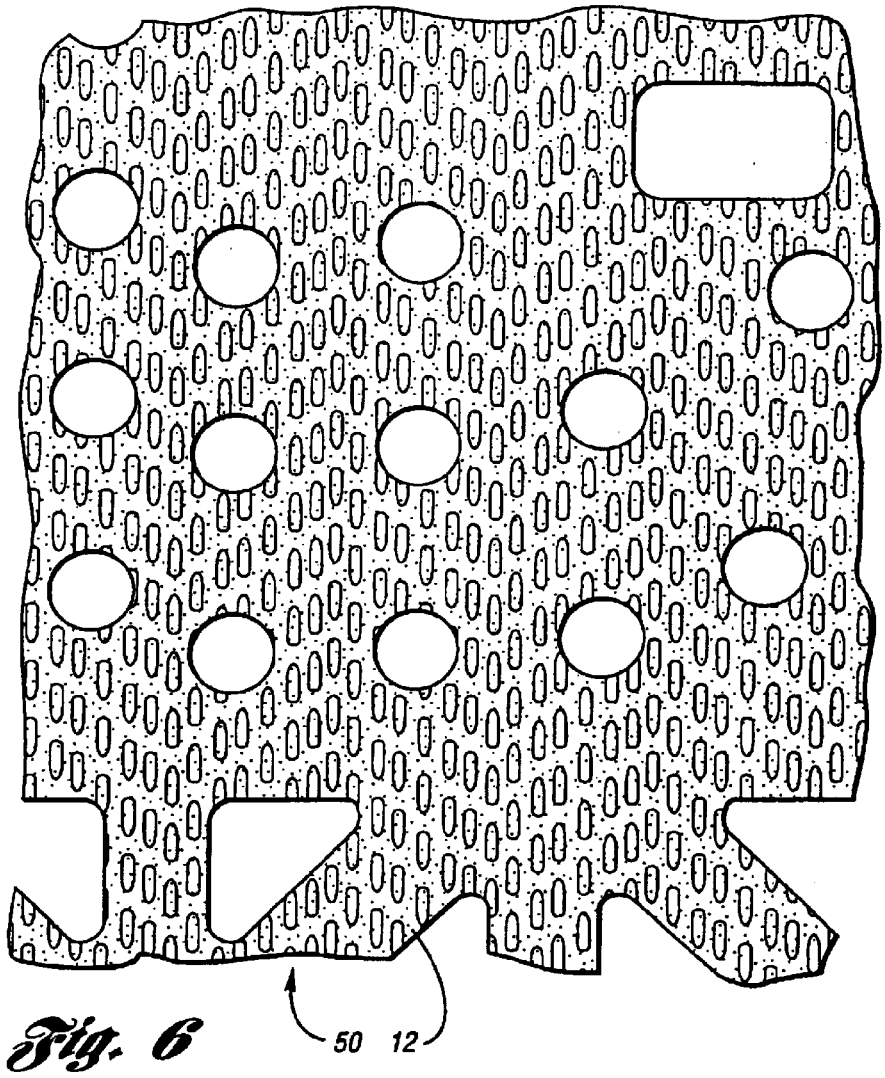
Figure 7:
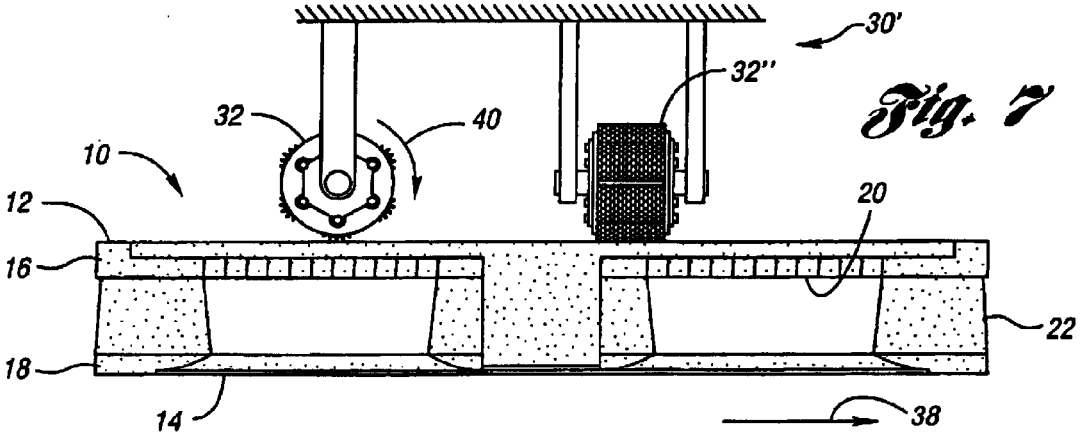
FIG. 7 is a side view of an alternative apparatus according to the present invention as applied to a pallet surface.

FIG. 6 illustrates an additional alternative and enlarged view of the corner portion 50 of plastic pallet 10 to which the apparatus 30 having cutter bundles 32 according to the present invention have been applied.

As shown in FIGS. 1 and 2, the cutter bundles 32 may be mounted to an automated apparatus fixture 30 for treating pallet surfaces, for example, on an automated line after molding and optionally cooling of the pallet. In this embodiment, the apparatus 30 includes a plurality of cutter shafts 34 oriented generally parallel to each other and spaced apart. The cutter bundles 30 are fixedly mounted to the cutter shafts 34. The shafts 34 rotate at a speed appropriate to the desired application. The shafts 34 may be driven with a single power source, and may also include a gearbox to modify the speed of rotation. As shown in the simplified schematic illustration of FIG. 1, as the pallet 10 moves along the line as designated by arrow 38, a first spindle 34 rotates cutter bundles 32 clockwise (in the direction of arrow 40), while a second spindle 34' rotates cutter bundles 32' counter-clockwise (in the direction of arrow 42), such that the teeth 27 of the serrated disks 26 cut into the pallet surfaces in order to define the scuffed surface. Apparatus 30 may also include a depth shoe to limit the depth into the pallet surface that cutter bundles 32 shave, which by example and not limitation may be a cutting depth of 1.0 mm. As shown in FIG. 2, it is contemplated that the cutter bundles 32 of one shaft 34 are oriented in an offset manner from the cutter bundles 32' of the other shaft 34', such that adjacent sections of the pallet have a scuffing texture in opposite directions.

It is also contemplated that cutter bundles 32 may be applied to the pallet surfaces to create multidirectional surface scuffing. As shown in the simplified schematic illustration of FIG. 7, apparatus 30' includes cutter bundles 32 and 32" are oriented in a perpendicular relation to each other, such that cutter bundle 32 is applied to surface 12, and then cutter bundle 32" takes a subsequent pass on surface 12, thereby shearing the surface in a plurality of directions and improving the slip resistance of the surface in a plurality of directions. Of course, while the cutter bundles 32 are shown as oriented in a perpendicular manner, they may be oriented in any number of orientations to define the multi-directional slip resistance to the pallet surface.

The cutter bundles 32 may be moved past the pallet surface, or preferably, the cutter bundles are fixed in position and relative movement between the cutter bundles and the pallet 10 may be accomplished by a carriage, i.e. a moving belt or series of links on which the pallets are placed or mounted. Any conventional means of producing relative movement of the cutter bundles and the pallet may be used.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A process for imparting texture to a plastic pallet to produce slip resistant surfaces, the process comprising providing an upper deck of a plastic pallet, said upper deck having an outward facing load bearing surface and an inward facing fork-lift contactable surface;

contacting at least said load bearing surface of said upper deck and optionally said fork-lift contactable surface of said upper deck with a scuffing device comprising at least one cutter bundle having a first plurality of cutting members axially aligned and mounted adjacent each other, the cutting members having radial toothed edges for cutting into and imparting texture to a plastic pallet surface upon rotating engagement therewith;

a first drive shaft upon which the at least one cutter bundle is mounted for providing rotational movement to the at least one cutter bundle; and a carriage for imparting relative movement between said at least one cuter bundle and a plastic pallet surface, such that at least one surface of said upper deck is scuffed by said cutting members.

2. The process of claim 1, further comprising a second cutter bundle mounted along a second shaft oriented parallel to said first drive shaft.

3. The process of claim 2, wherein the second cuter bundle is oriented offset from the at least one cutter bundle such that during rotation they form parallel scuffing patterns along the surface of the plastic pallet.

4. The process of claim 1 wherein said carriage for imparting relative movement comprises a conveying device on which a plastic pallet or deck thereof are conveyed past said at least one cutter bundle.

5. The process of claim 1, further comprising a second plurality of cutting members disposed along a second drive shaft in the same plane as said first drive shaft.

6. The process of claim 5, wherein the second plurality of cutting members is oriented offset from the first plurality of cutting members and wherein said second drive shaft is parallel to said first drive shaft such that during rotation, the first plurality of cutting members and the second plurality of cutting members form parallel scuffing patterns along a plastic surface.

7. The process of claim 5, wherein said first plurality of cutting members traverse a surface of a plastic pallet or pallet deck in a first direction, and said second plurality of cutting members traverse said surface in a direction different from said first direction.

8. The process of claim 6, wherein said first plurality of cutting members and said second plurality of cutting members rotate in opposing directions.

9. The process of claim 1, wherein said first plurality of cutting members are disposed in or above a plane of said outer load bearing surface or said fork-lift contactable surface.

10. The process of claim 1, wherein said first plurality of cutting members are disposed in or below a plane of said outer load bearing surface or said fork-lift contactable surface.

11. The process of claim 1, wherein said upper deck has been previously assembled into a plastic pallet prior to contact with said cutting members.

12. The process of claim 1, wherein said upper deck is contacted with said cutting members, and thereafter is joined together with other plastic members to form a plastic pallet.

13. The process of claim 1, wherein said outward facing load bearing surface of said upper deck and said inward facing fork-lift-contactable surface of said upper deck are both scuffed, and thereafter said upper deck is joined together with other plastic members to form a plastic pallet.

14. A pallet scuffing apparatus suitable for use in the process of claim 1, said apparatus comprising said first plurality of cutting members mounted on the first rotatable drive shaft, said drive shaft parallel to the plane of a surface of said upper deck; and said carriage for imparting relative movement between said first drive shaft and a plastic pallet surface.

15. The apparatus of claim 14, wherein said first drive shaft contains a plurality of the spaced apart cutting bundles.

16. The apparatus of claim 15, faith comprising a second drive shaft having disposed thereon a second plurality of spaced apart cutting bundles, said second drive shaft parallel to said first drive shaft and rotating in a direction counter to the direction of said first drive shaft.

17. The apparatus of claim 14, wherein said carriage comprises a conveying device on which a plastic pallet or upper deck thereof is conveyed past said cutting bundle(s).

* * * * *